US005510234A

United States Patent [19]

Weber

[11] Patent Number: 5,510,234

[45] Date of Patent: Apr. 23, 1996

[54] COLOR PHOTOGRAPHIC SILVER HALIDE MATERIAL

[75] Inventor: Beate Weber, Leichlingen, Germany

[73] Assignee: Agfa - Gevaert AG, Germany

[21] Appl. No.: 517,433

[22] Filed: Aug. 21, 1995

[30] Foreign Application Priority Data

Aug. 31, 1994 [DE] Germany ..... 44 30 948.1

[51] Int. Cl.[6] ..... G03C 7/388

[52] U.S. Cl. ..... 430/546; 430/551; 430/558; 430/631

[58] Field of Search ..... 430/551, 546, 430/558, 631

[56] References Cited

U.S. PATENT DOCUMENTS 5,019,493 5/1991 Sato et al. ..... 430/546
5,258,278 11/1993 Merkel et al. ..... 430/546

FOREIGN PATENT DOCUMENTS 0270341 6/1988 European Pat. Off. ..... 430/551
0300259 1/1989 European Pat. Off. ..... 430/631
0480292 4/1992 European Pat. Off.
0486929 5/1992 European Pat. Off.
0601836 6/1994 European Pat. Off.

*Primary Examiner*—Lee C. Wright
*Attorney, Agent, or Firm*—Connolly & Hutz

[57] ABSTRACT

Compounds corresponding to formula (I):

(I)

in which $R_1$ represents alkyl, alkenyl, cycloalkyl or cycloalkenyl, $R_2$ and $R_3$ independently of one another represent H, alkyl, alkenyl, cycloalkyl or cycloalkenyl, $R_4$ represents alkylene or alkenylene, X represents CO or $SO_2$, m 0 or 1 and l is a number of 1 to 5, as coupler solvents lead to steeper gradation and greater maximum densities.

10 Claims, No Drawings

COLOR PHOTOGRAPHIC SILVER HALIDE MATERIAL

This invention relates to a color photographic silver halide material containing a new coupler solvent.

Color photographic silver halide materials which produce dye images by the chromogenic method normally contain at least one blue-sensitive silver halide emulsion layer containing at least one yellow coupler, at least one green-sensitive silver halide emulsion layer containing at least one magenta coupler and at least one red-sensitive silver halide emulsion layer containing at least one cyan coupler. The couplers are normally dissolved or dispersed in fine droplets of a so-called coupler solvent.

Suitable and typical coupler solvents are, for example, tricresyl phosphate (TCP), dibutyl phthalate (DBP) and also fatty acid amides, such as diethyl lauramide.

It is still not possible with these coupler solvents to obtain sufficiently steep gradation or sufficiently high maximum densities.

Accordingly, the problem addressed by the present invention was to provide new coupler solvents with which improved maximum densities and steeper gradations could be obtained, but which would not adversely affect dye stability.

It has now been found that this problem can be solved with the compounds corresponding to formula (I) described hereinafter.

Accordingly, the present invention relates to a color photographic silver halide material of the type mentioned at the beginning which is characterized in that at least one coupler is dissolved or dispersed in a compound corresponding to formula (I):

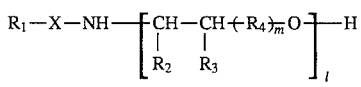

(I)

in which $R_1$ represents alkyl, alkenyl, cycloalkyl or cycloalkenyl, $R_2$ and $R_3$ independently of one another represent H, alkyl, alkenyl, cycloalkyl or cycloalkenyl, $R_4$ represents alkylene or alkenylene, X represents CO or $SO_2$, m 0 or 1 and 1 is a number of 1 to 5.

The alkyl and alkenyl radicals may be linear or branched, unsubstituted or substituted.

$R_1$ is preferably linear or branched alkyl or alkenyl containing $\geqq 8$ carbon atoms.

$R_2$ and $R_3$ independently of one another are preferably hydrogen or methyl.

$R_4$ is preferably linear or branched alkylene containing 1 to 8 carbon atoms.

1 Preferably has a value of 1 while m is preferably 0.

Within formula (I), compounds corresponding to formulae (II) and (III):

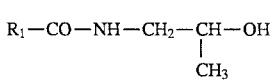

(II)

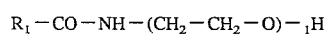

(III)

in which $R_1$ and 1 are as defined above, are particularly preferred.

The following are examples of compounds corresponding to formulae (I) to (III):

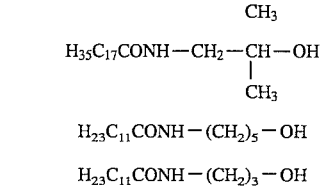

I-1

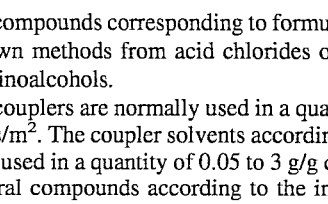

I-2

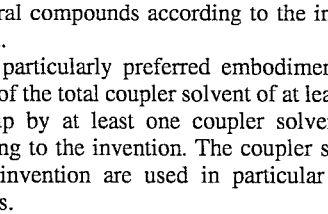

I-3

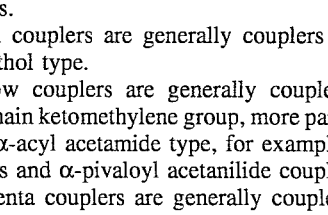

I-4

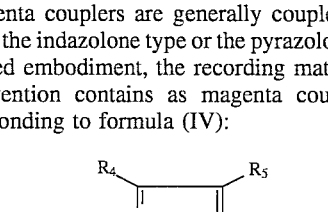

I-5

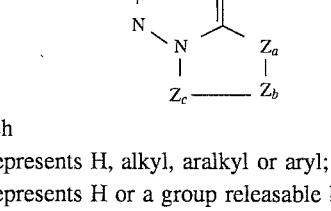

I-6

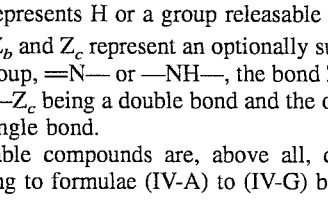

I-7

The compounds corresponding to formula (I) are prepared by known methods from acid chlorides or acid anhydrides and aminoalcohols.

The couplers are normally used in a quantity of 0.1 to 100 mmoles/$m^2$. The coupler solvents according to the invention may be used in a quantity of 0.05 to 3 g/g coupler. A mixture of several compounds according to the invention may also be used.

In a particularly preferred embodiment, 15 to 50% by weight of the total coupler solvent of at least one coupler are made up by at least one coupler solvent of formula (I) according to the invention. The coupler solvents according to the invention are used in particular for the magenta couplers.

Cyan couplers are generally couplers of the phenol or α-naphthol type.

Yellow couplers are generally couplers containing an open-chain ketomethylene group, more particularly couplers of the α-acyl acetamide type, for example benzoyl anilide couplers and α-pivaloyl acetanilide couplers.

Magenta couplers are generally couplers of the 5-pyrazolone, the indazolone type or the pyrazoloazole type. In one preferred embodiment, the recording material according to the invention contains as magenta couplers compounds corresponding to formula (IV):

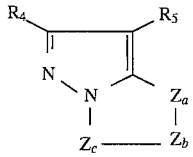

(IV)

in which $R_4$ represents H, alkyl, aralkyl or aryl;

$R_5$ represents H or a group releasable by coupling;

$Z_a$, $Z_b$ and $Z_c$ represent an optionally substituted methine group, =N— or —NH—, the bond $Z_a$–$Z_b$ or the bond $Z_b$–$Z_c$ being a double bond and the other bond being a Single bond.

Suitable compounds are, above all, compounds corresponding to formulae (IV-A) to (IV-G) below:

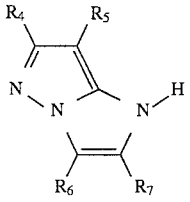

(IV-A)

-continued (IV-B)

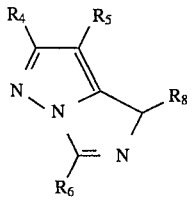

(IV-C)

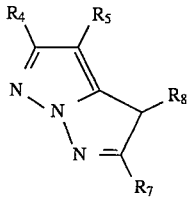

(IV-D)

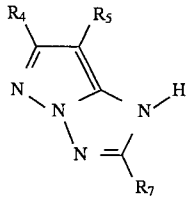

(IV-E)

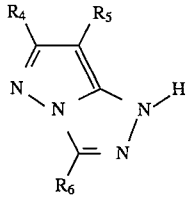

(IV-F)

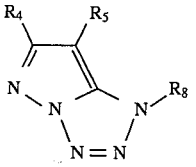

(IV-G)

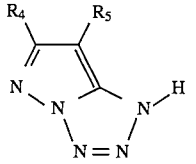

In general formulae (IV-A) to (IV-G), $R_4$, $R_6$, $R_7$ and $R_8$ represent hydrogen, alkyl, aralkyl, aryl, alkoxy, aroxy, alkylthio, arylthio, amino, anilino, acylamino, cyano, alkoxycarbonyl, carbamoyl, sulfamoyl, which may in turn be substituted.

In addition, $R_5$ represents hydrogen or a group releasable during the color coupling reaction, such as a halogen atom or a preferably cyclic group attached to the coupling position by an oxygen atom, a sulfur atom or a nitrogen atom.

If the releasable group is a cyclic group, it may be attached to the coupling position of the coupler molecule either directly by an atom forming part of a ring, for example a nitrogen atom, or indirectly via an intermediate binding link. Releasable groups such as these are known in large numbers, for example as leaving groups of 2-equivalent magenta couplers.

Examples of releasable groups attached by oxygen correspond to the following formula:

$$—O—R_9$$

in which $R_9$ is an acyclic or cyclic organic radical, for example alkyl, aryl, a heterocyclic group or acyl derived, for example, from an organic carboxylic or sulfonic acid. In particularly preferred releasable groups of this type, $R_{15}$ is an optionally substituted phenyl group.

Examples of releasable groups attached by nitrogen can be found in DE-OS 2 536 191, 2 703 589, 2 813 522 and 3 339 201.

The groups in question are often 5-membered heterocyclic rings which are attached to the coupling position of the magenta coupler by a ring nitrogen atom. The heterocyclic rings often contain activating groups, for example carbonyl or sulfonyl groups or double bonds adjacent the nitrogen atom establishing the bond to the coupler molecule.

If the releasable group is attached to the coupling position of the coupler by a sulfur atom, it may be the residue of a diffusible carbocyclic or heterocyclic mercapto compound which is capable of inhibiting the development of silver halide. Inhibitor residues such as these have often been described as releasable groups attached to the coupling position of couplers, including magenta couplers, for example in U.S. Pat. No. 3,227,554.

Particularly preferred couplers correspond to formula IV-D and IV-E.

The following are examples of pyrazoloazole couplers corresponding to formula IV:

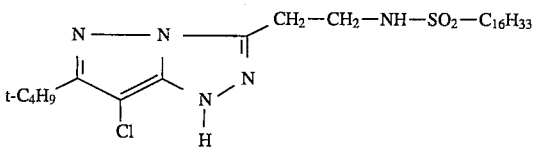

B-1

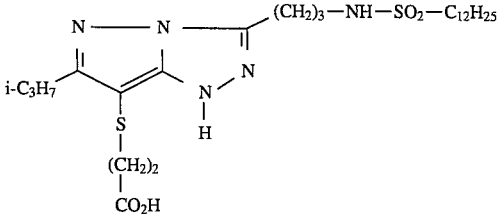

B-2

-continued
B-3
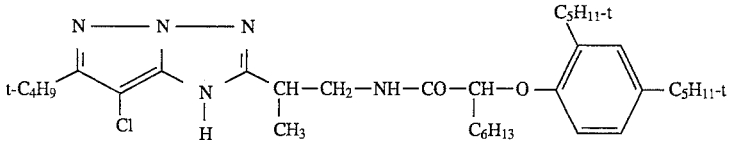
B-4
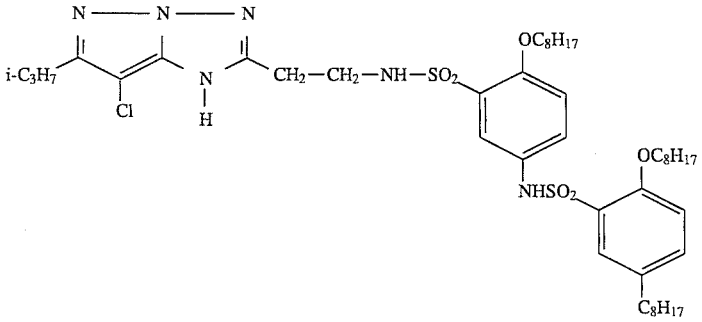
B-5
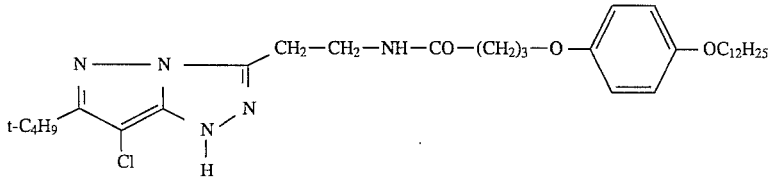
B-6
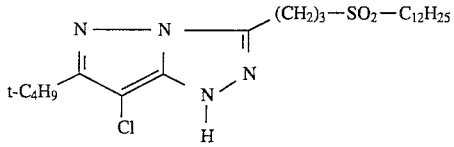
B-7
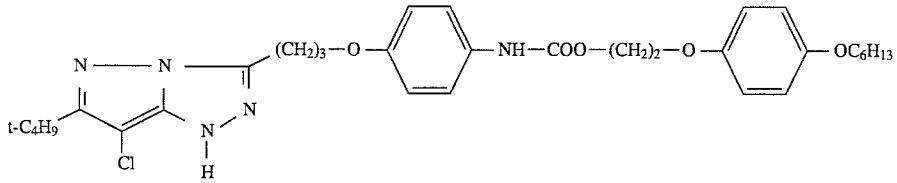
B-8
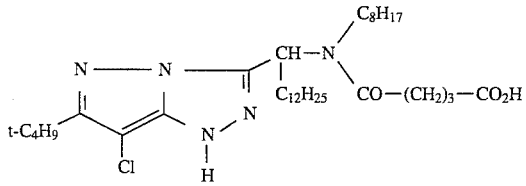
B-9
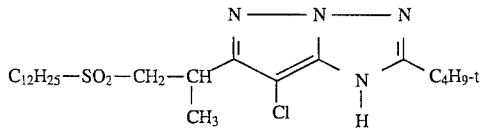
B-10
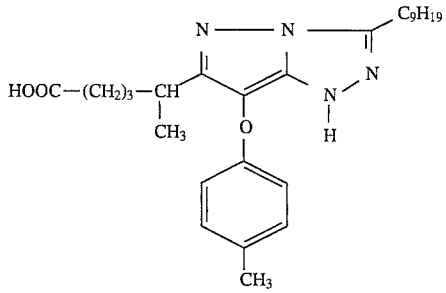

-continued
B-11
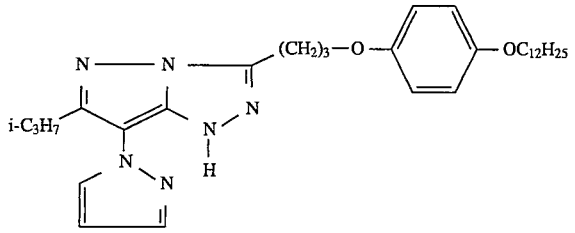
B-12
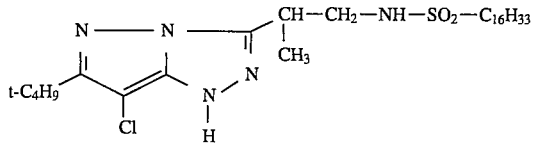
B-13
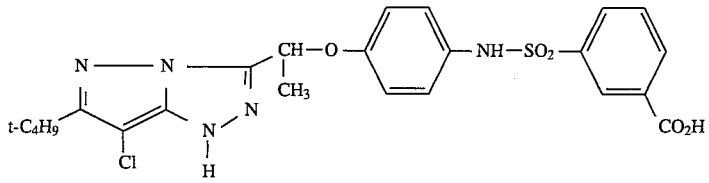
B-14
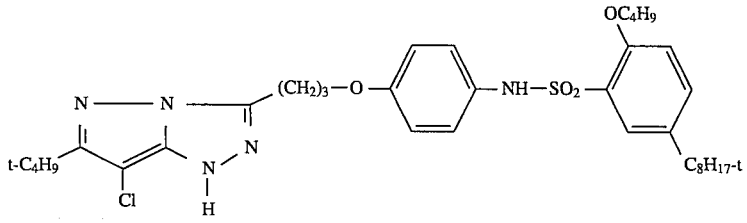
B-15
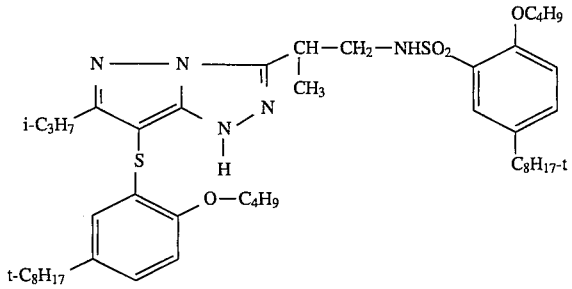
B-16
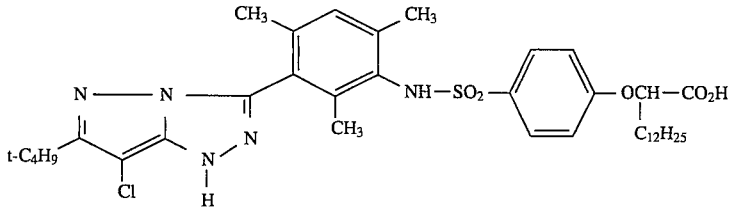
B-17
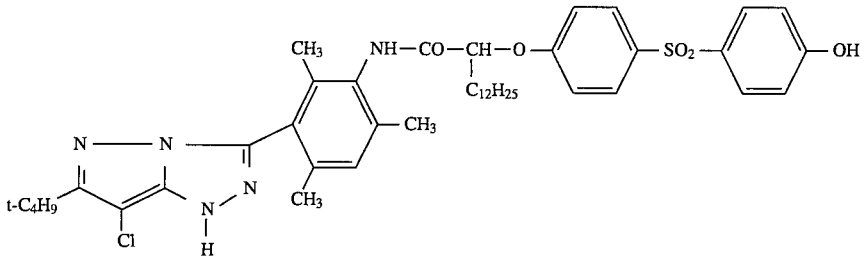

-continued
B-18
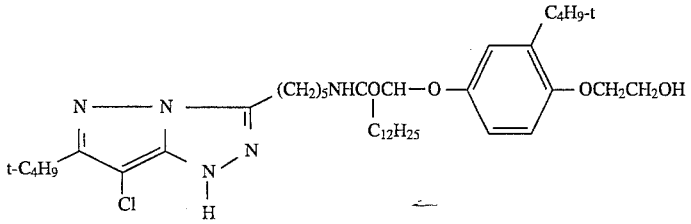
B-19
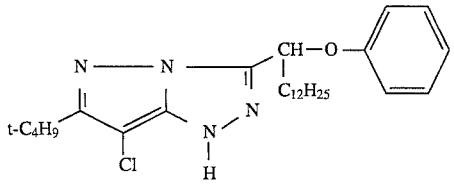
B-20
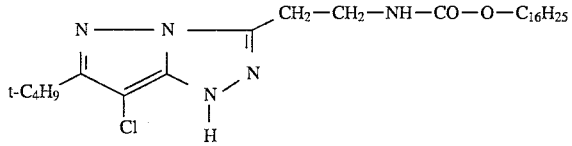
B-21
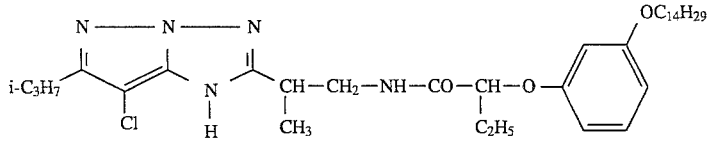
B-22
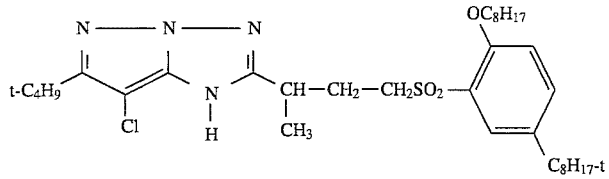
B-23
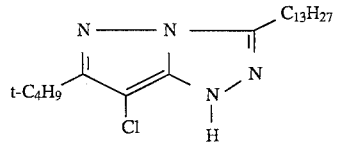
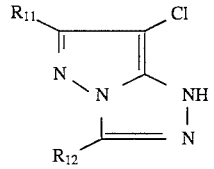
B-24
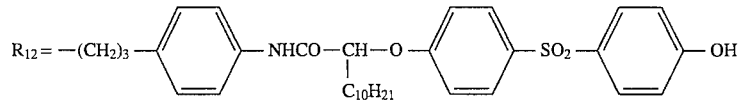
$R_{11} = CH_3$
B-25
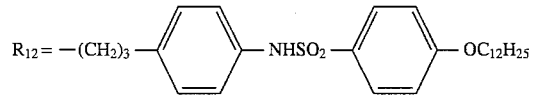
$R_{11} = CH_3$ -continued
B-26
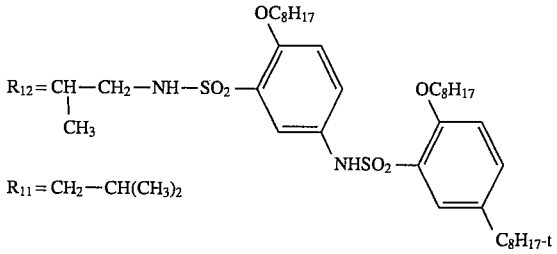
B-27
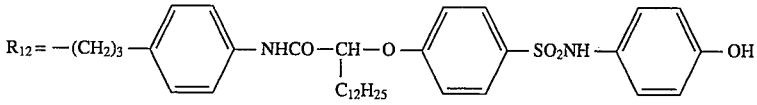
B-28
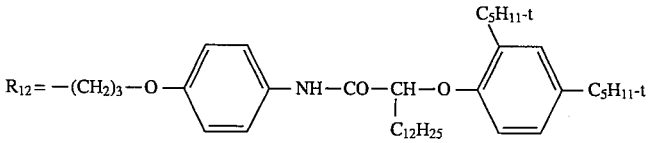
B-29
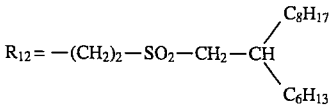
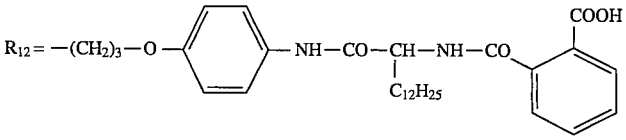
B-30
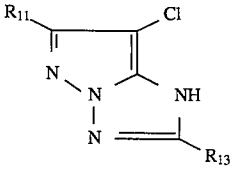
B-31
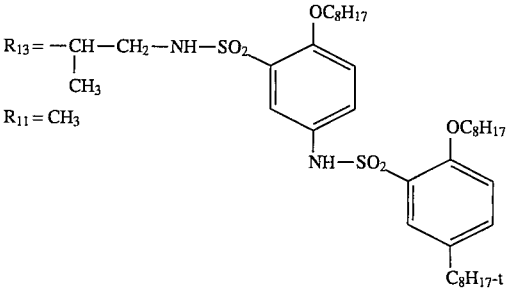
B-32
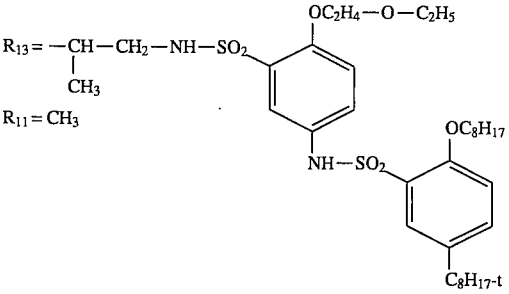

-continued

B-33

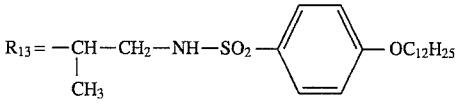

$R_{11} = C_3H_7$-n

B-34

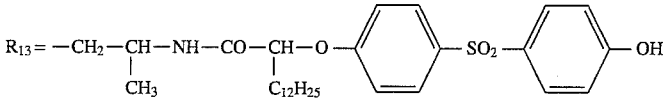

$R_{11} = CH_3$

In one preferred embodiment of the invention, at least one light stabilizer corresponding to formula (V):

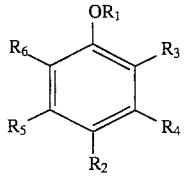

(V)

in which $R_1$ represents H, alkyl, aryl, acyl;

$R_2$ represents —$OR_1$, —COOH, alkyl, aryl, dialkylamino, acylamino, sulfonamido, acyl, sulfonyl;

$R_3$, $R_4$, $R_5$, $R_6$ represent H, halogen or have the same meaning as $R_2$ or two adjacent substituents —$OR_1$, $R_2$, $R_3$, $R_4$, $R_5$ and $R_6$ can together complete a 5- to 8-membered ring, may be used together with the compounds according to the invention.

An acyl group, even in conjunction with acylamino, is derived in particular from a carboxylic, carbamic, carbonic or sulfonic acid.

The compounds corresponding to formula V are used in particular in a quantity of 0.05 to 3 g/g coupler.

In other preferred embodiments of the invention, the compound (V) corresponds in particular to one of formulae (Va) to (Vh):

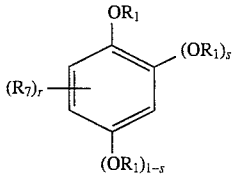

(Va)

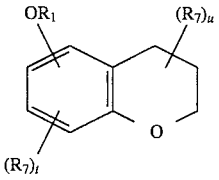

(Vb)

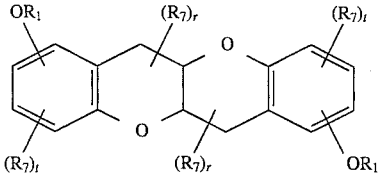

(Vc)

-continued

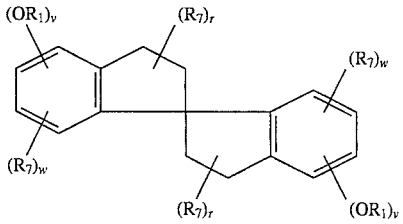

(Vd)

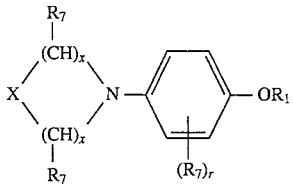

(Ve)

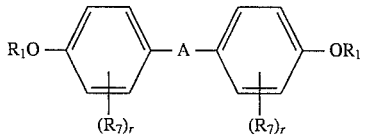

(Vf)

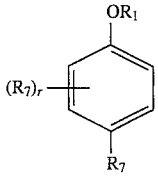

(Vg)

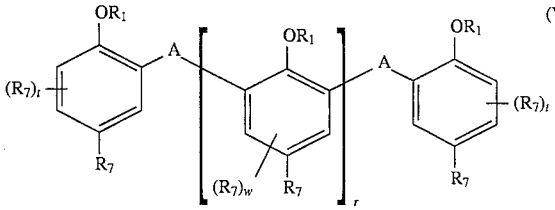

(Vh)

in which $R_7$ represents alkyl, acyl, acylamino, sulfonamido, sulfonyl;

A is a single bond, —$CH(R_8)$—, —O—, —S—, —$SO_2$—, —$NR_9$—,

X is —O—, —S—, —SO—, —$SO_2$—, —N-acyl—, —CO—, $R_8$ represents H, alkyl, $R_9$ represents H, alkyl, acyl, sulfonyl, r=0, 1, 2, 3 or 4;

s=0 or 1;

t=0, 1, 2 or 3;

u=0, 1, 2, 3, 4, 5 or 6;

v=1 or 2;

w=0, 1 or 2 and x=1, 2 or 3.
Several substituents $R_7$ and r, t, v, w and x may be the same or different. The foregoing definition of acyl for $R_1$ to $R_6$ applies the acyl group present in X and to (formula Ve) and for a possible acyl group in $R_7$ and $R_9$.
The following are examples of compounds corresponding to formula (V) according to the invention:
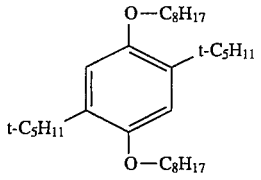
C-1
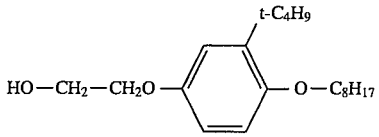
C-2
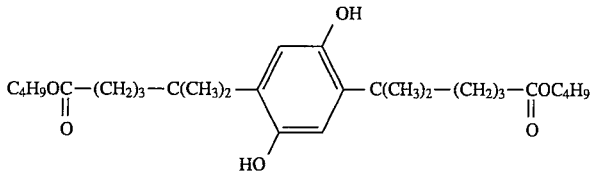
C-3
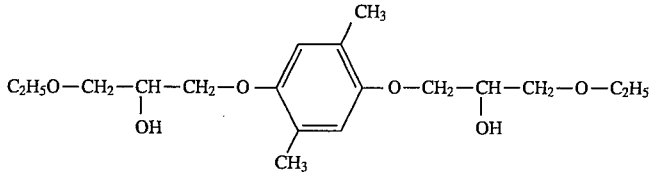
C-4
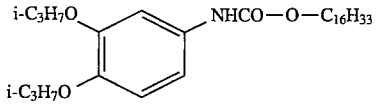
C-5
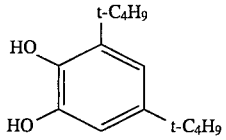
C-6
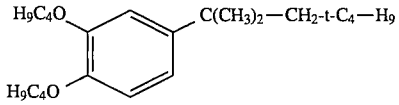
C-7
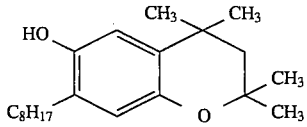
C-8
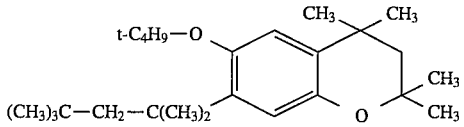
C-9
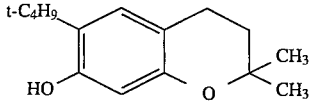
C-10

-continued
C-11
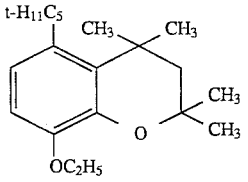
C-12
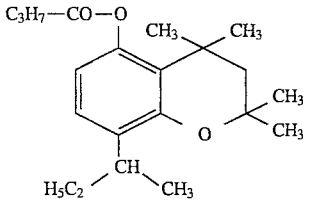
C-13
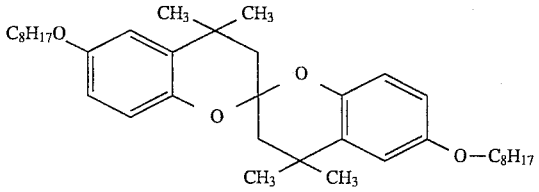
C-14
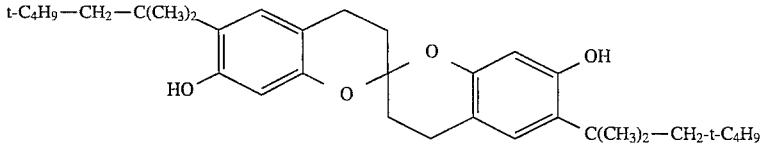
C-15
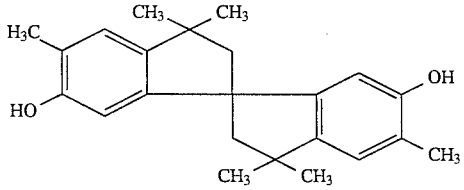
C-16
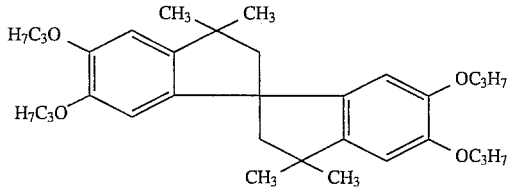
C-17
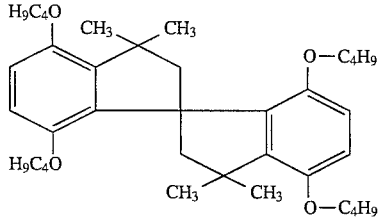
C-18
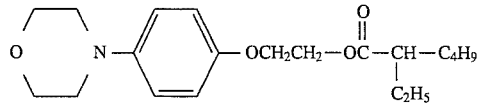
C-19
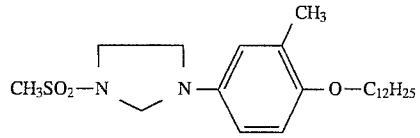

-continued
C-20
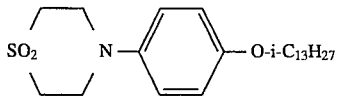
C-21
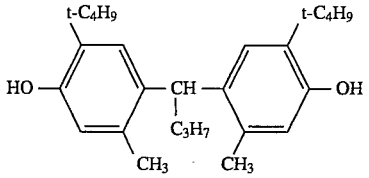
C-22
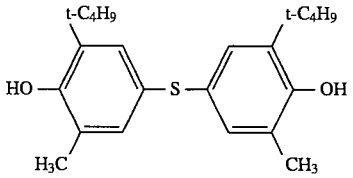
C-23
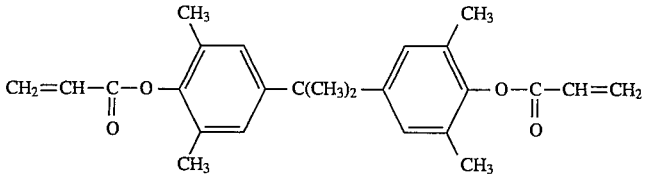
C-24
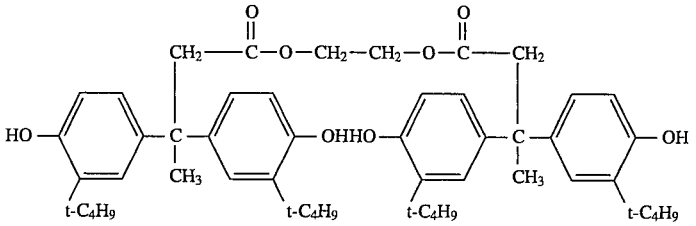
C-25
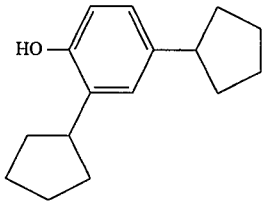
C-26
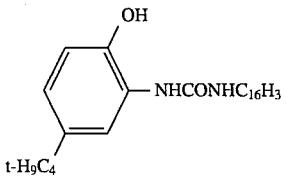
C-27
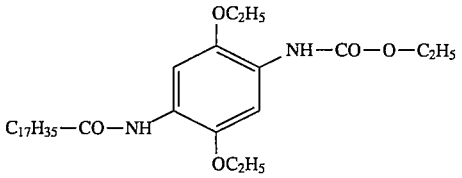
C-28
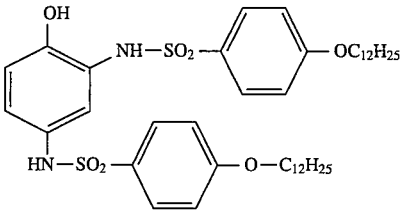

-continued

C-29

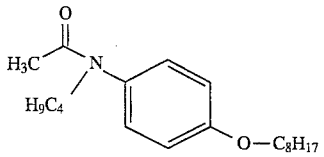

C-30

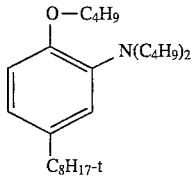

C-31

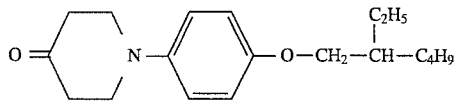

C-32

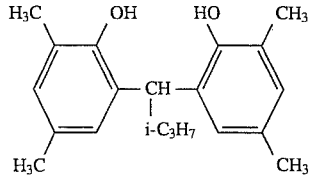

C-33

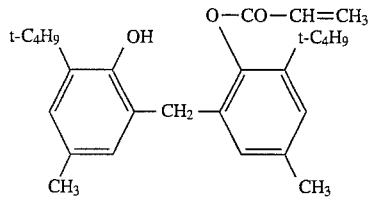

C-34

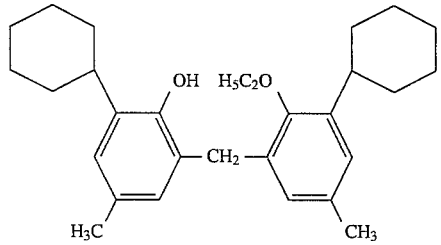

C-35

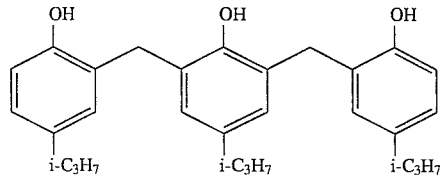

C-36

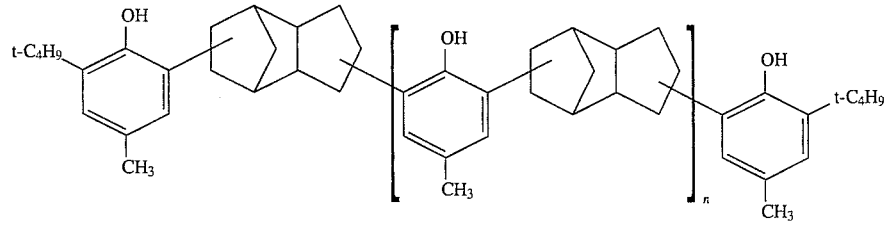

where n=2.5.

The color photographic recording material according to the invention contains at least one photosensitive silver halide emulsion layer and preferably a sequence of several such photosensitive silver halide emulsion layers and optionally other auxiliary layers, such as in particular protective layers and non-photosensitive binder layers arranged between the photosensitive layers, a compound according to the invention in combination with a color coupler, preferably a magenta coupler, being associated in accordance with the present invention with at least one of the photosensitive silver halide emulsion layers present.

Examples of color photographic materials are color negative films, color reversal films, color positive films, color photographic paper, color reversal photographic paper, dye-sensitive materials for the dye diffusion transfer process or the silver dye bleaching process.

Suitable supports for the production of color photographic materials are, for example, films of semisynthetic and synthetic polymers, such as cellulose nitrate, cellulose acetate, cellulose butyrate, polystyrene, polyvinyl chloride, polyethylene terephthalate and polycarbonate, and paper laminated with a baryta layer or α-olefin polymer layer (for example polyethylene). These supports may be dyed with dyes and pigments, for example titanium dioxide. They may also be dyed black for the purpose of screening against light. The surface of the support is generally subjected to a treatment to improve the adhesion of the photographic emulsion layer, for example to a corona discharge with subsequent application of a substrate layer.

Key components of the photographic emulsion layers are binders, silver halide crystals and color couplers. Gelatine is preferably used as binder. However, it may be completely or partly replaced by other synthetic, semisynthetic or even naturally occurring polymers.

The binders should contain an adequate number of functional groups, so that sufficiently resistant-layers can be produced by reaction with suitable hardeners. Functional groups of the type in question are, in particular, amino groups and also carboxyl groups, hydroxyl groups and active methyl groups.

The silver halide present as photosensitive constituent in the photographic material may contain as-halide chloride, bromide or iodide and mixtures thereof. For example, 0 to 15 mole-% of the halide of at least one layer may consist of iodide, 0 to 100 mole-% of chloride and 0 to 100 mole-% of bromide. Silver bromide iodide emulsions are normally used in the case of color negative and color reversal films while silver chloride bromide emulsions of high chloride content up to pure silver chloride emulsions are normally used in the case of color negative and color reversal paper. The silver halide may consist of predominantly compact crystals which may have, for example, a regular cubic or octahedral form or transitional forms. However, the silver halide may also consist with advantage of platelet-like crystals of which the average diameter-to-thickness ratio is preferably at least 5:1, the diameter of a crystal being defined as the diameter of a circle with an area corresponding to the projected area of the crystal. AgBrCl emulsions containing at least 80 mole-% of AgCl and, more particularly, at least 95 mole-% of AgCl are preferably used.

The silver halide grains may also have a multiple-layer grain structure, in the most simple case with an inner and an outer Core region (core/shell), the halide composition and/or other modifications such as, for example, doping of the individual grain regions, being different. The average grain size of the emulsions is preferably between 0.2 μm and 2.0 μm; the grain size distribution may be both homodisperse and heterodisperse. A homodisperse grain size distribution means that 95% of the grains differ from the average grain size by no more than ±30%. In addition to the silver halide, the emulsions may also contain organic silver salts, for example silver benztriazolate or silver behenate.

Two or more types of silver halide emulsions prepared separately may also be used in the form of a mixture.

The photographic emulsions may be prepared from soluble silver salts and soluble halides by various methods (cf. for example P. Glafkides, Chimie et Physique Photographique, Paul Montel, Paris (1967); G. F. Duffin, Photographic Emulsion Chemistry, The Focal Press, London (1966); V. L. Selikman et al, Making and Coating Photographic Emulsion, The Focal Press, London (1966)).

On completion of crystal formation or even at an earlier stage, the soluble salts are removed from the emulsion, for example by noodling and washing, by flocculation and washing, by ultrafiltration or by ion exchangers.

The silver halide emulsion is generally subjected to chemical sensitization under defined conditions (pH, pAg, temperature, gelatine, silver halide and sensitizer concentration) until sensitivity and fogging are both optimal. The process is described, for example, in H. Frieser "Die Grundlagen der Photographischen Prozesse mit Silberhalogeniden" pages 675–734, Akademische Verlagsgesellschaft (1968).

Chemical sensitization may be carried out with addition of compounds of sulfur, selenium, tellurium and/or compounds of metals of the VIIIth secondary group of the periodic system (for example gold, platinum, palladium, iridium). Thiocyanate compounds, surface-active compounds, such as thioethers, heterocyclic nitrogen compounds (for example imidazoles, azaindenes) or even spectral sensitizers (described for example in F. Hamer "The Cyanine Dyes and Related Compounds", 1964 and in Ullmanns Encyclopä die der technischen Chemie, 4th Edition, Vol. 18, pages 431 et seq and Research Disclosure No. 17643 (December 1978), Chapter III) may also be added. Reduction sensitization with addition of reducing agents (tin(II) salts, amines, hydrazine derivatives, aminoboranes, silanes, formamidine sulfinic acid) may be carried out instead of or in addition to chemical sensitization by hydrogen, by a low pAg value (for example below 5) and/or a high pH value (for example above 8).

The photographic emulsions may contain compounds to prevent fogging or to stabilize the photographic function during production, storage and photographic processing.

Particularly suitable compounds of this type are azaindenes, preferably tetra- and pentaazaindenes, particularly those substituted by hydroxyl or amino groups. Compounds such as these are described, for example, by Birr, Z. Wiss. Phot. 47 (1952) pages 2 to 58. Other suitable antifogging agents are salts of metals, such as mercury or cadmium, aromatic sulfonic acids or sulfinic acids, such as benzenesulfinic acid, or nitrogen-containing heterocycles, such as nitrobenzimidazole, nitroindazole, optionally substituted benztriazoles or benzthiazolium salts. Heterocycles containing mercapto groups are particularly suitable, examples of such compounds being mercaptobenzthiazoles, mercaptobenzimidazoles, mercaptotetrazoles, mercaptothiadiazoles, mercaptopyrimidines; these mercaptoazoles may even contain a water-solubilizing group, for example a carboxyl group or sulfo group. Other suitable compounds are published in Research Disclosure 17643 (December 1978), Chapter VI.

The stabilizers may be added to the silver halide emulsions before, during or after ripening. The compounds may of course also be added to other photographic layers associated with a silver halide layer.

Mixtures of two or more of the compounds mentioned may also be used.

The photographic emulsion layers or other hydrophilic colloid layers of the photosensitive material produced in accordance with the invention may contain surface-active agents for various purposes, such as coating aids, for preventing electrical charging, for improving surface slip, for emulsifying the dispersion, for preventing adhesion and for improving the photographic characteristics (for example development acceleration, high contrast, sensitization, etc.). In addition to natural surface-active compounds, for example saponin, synthetic surface-active compounds (surfactants) are mainly used: nonionic surfactants, for example alkylene oxide compounds, glycerol compounds or glycidol compounds; cationic surfactants, for example higher alkylamines, quaternary ammonium salts, pyridine compounds and other heterocyclic compounds, sulfonium compounds or phosphonium compounds; anionic surfactants containing an acid group, for example a carboxylic acid, sulfonic acid, phosphoric acid, sulfuric acid ester or phosphoric acid ester group; ampholytic surfactants, for example amino acid and aminosulfonic acid compounds and also sulfur or phosphoric acid esters of an aminoalcohol.

The photographic emulsions may be spectrally sensitized using methine dyes or other dyes. Particularly suitable dyes are cyanine dyes, merocyanine dyes and complex merocyanine dyes.

A review of the polymethine dyes suitable as spectral sensitizers, suitable combinations thereof and supersensitizing combinations thereof can be found in Research Disclosure 17643 (December 1978), Chapter IV.

The following dyes (in order of spectral regions) are particularly suitable:

1. as red sensitizers 9-ethylcarbocyanines with benzthiazole, benzselenoazole or naphthothiazole as basic terminal groups, which may be substituted in the 5- and/or 6-position by halogen, methyl, methoxy, carbalkoxy, aryl, and also 9-ethyl naphthoxathia- or selenocarbocyanines and 9-ethyl naphthothiaoxa- and benzimidazocarbocyanines, providing the dyes contain at least one sulfoalkyl group at the heterocyclic nitrogen;
2. as green sensitizers 9-ethylcarbocyanines with benzoxazole, naphthoxazole or a benzoxazole and a benzthiazole as basic terminal groups and also benzimidazocarbocyanines which may also be further substituted and must also contain at least one sulfoalkyl group at the heterocyclic nitrogen;
3. as blue sensitizers symmetrical or asymmetrical benzimidazo-, oxa-, thia- or selenacyanines containing at least one sulfoalkyl group at the heterocyclic nitrogen and, optionally, other substituents at the aromatic nucleus and also apomerocyanines containing a thiocyanine group.

There is no need for sensitizers where the natural sensitivity of the silver halide is sufficient for a certain spectral region, for example the blue sensitivity of silver bromides.

There is no need for sensitizers where the natural sensitivity of the silver halide is sufficient for a certain spectral region, for example the blue sensitivity of silver bromides.

The color couplers may be 4-equivalent couplers and also 2-equivalent couplers. 2-Equivalent couplers are derived from the 4-equivalent couplers in that they contain in the coupling position a substituent which is eliminated during the coupling reaction. 2-Equivalent couplers include both those which are substantially colorless and also those which have a strong color of their own which either disappears during the color coupling reaction or is replaced by the color of the image dye produced (mask couplers) and white couplers which give substantially colorless products on reaction with color developer oxidation products. 2-Equivalent couplers also include couplers which, in the coupling position, contain a releasable group which is released on reaction with color developer oxidation products and develops a certain desired photographic activity, for example as a development inhibitor or accelerator, either directly or after one or more other groups have been released from the group initially released (for example DE-A-27 03 145, DE-A-28 55 697, DE-A-31 05 026, DE-A-33 19 428). Examples of 2-equivalent couplers such as these are the known DIR couplers and also DAR and FAR couplers.

DIR couplers containing development inhibitors of the azole type, for example triazoles and benzotriazoles, are described in DE-A-24 14 006, 26 10 546, 26 59 417, 27 54 281, 28 42 063, 36 26 219, 36 30 564, 36 36 824, 36 44 416. Further advantages in regard to color reproduction, i.e. color separation and color purity, and in regard to detail reproduction, i.e. sharpness and graininess, can be obtained with DIR couplers which, for example, do not release the development inhibitor as the direct result of coupling with an oxidized color developer, but only after a further reaction, for example with a timing group. Examples of DIR couplers such as these can be found in DE-A-28 55 697, 32 99 671, 38 18 231, 35 18 797, in EP-A- 0 157 146 and 0 204 175, in U.S. Pat. No. 4,146,396 and 4,438,393 and in GB-A-2, 072,363.

DIR couplers releasing a development inhibitor which is decomposed in the developer bath to photographically substantially inactive products are described, for example, in DE-A-3 209 486 and in EP-A-0 167 168 and 0 219 713. Problem-free development and stable processing are achieved by this measure.

Where DIR couplers, particularly those releasing a readily diffusible development inhibitor, are used, improvements in color reproduction, for example a more differentiated color reproduction, can be obtained by suitable measures during optical sensitization, as described for example in EP-A-0 115 304, 0 167 173, GB-A-2,165,058, DE-A-37 00 419 and U.S. Pat. No. 4,707,436.

In a multilayer photographic material, the DIR couplers may be added to various layers, including for example even non-photosensitive layers or interlayers. However, they are preferably added to the photosensitive silver halide emulsion layers, the characteristic properties of the silver halide emulsion, for example its iodide content, the structure of the silver halide grains or their grain size distribution, influencing the photographic properties obtained. The effect of the inhibitors released may be limited, for example by the incorporation of an inhibitor-trapping layer according to DE-A-24 31 223. For reasons of reactivity or stability, it may be of advantage to use a DIR coupler which, in the particular layer into which it is introduced,- forms a color differing from the color to be produced in that layer during the coupling reaction.

To increase sensitivity, contrast and maximum density, it is possible to use above all DAR or FAR couplers which release a development accelerator or a fogging agent. Compounds of this type are described, for example, in DE-A-25 34 466, 32 09 110, 33 33 355, 34 10 616, 34 29 545, 34 41 823, in EP-A-0 089 834, 0 110 511, 0 118 087, 0 147 765 and in U.S. Pat. Nos. 4,618,572 and 4,656,123.

An example of the use of BAR (bleach accelerator releasing) couplers can be found in EP-A-193 389.

It can be of advantage to modify the effect of a photographically active group released from the coupler by an intermolecular reaction between this group after its release and another group in accordance with DE-A-35 06 805.

Since, in the case of DIR, DAR and FAR couplers, the activity of the group released during the coupling reaction is largely desirable with less importance being attributed to the dye-producing properties of these couplers, DIR, DAR and FAR couplers which give substantially colorless products during the coupling reaction are also suitable (DE-A-15 47 640).

The releasable group may also be a ballast group so that coupling products which are diffusible or at least show slight or limited mobility are obtained in the reaction with color developer oxidation products (U.S. Pat. No. 4,420,556).

The material may also contain compounds different from couplers which may release, for example, a development inhibitor, a development accelerator, a bleach accelerator, a developer, a silver halide solvent, a fogging agent or an anti-fogging agent, for example so-called DIR hydroquinones and other compounds of the type described, for example, in U.S. Pat. No. 4,636,546, 4,345,024, 4,684,604 and in DE-A-31 45 640, 25 15 213, 24 47 079 and in EP-A-198 438. These compounds perform the same function as the DIR, DAR or FAR couplers except that they do not form coupling products.

High molecular weight color couplers are described, for example, in DE-C-1 297 417, DE-A-24 07 569, DE-A-31 48 125, DE-A-32 17 200, DE-A-33 20 079, DE-A-33 24 932, DE-A-33 31 743, DE-A-33 40 376, EP-A-27 284, U.S. Pat. No. 4,080,211. The high molecular weight color couplers are generally produced by polymerization of ethylenically unsaturated monomeric color couplers. However, they may also be obtained by polyaddition or polycondensation.

The couplers or other compounds may be incorporated in silver halide emulsion layers by initially preparing a solution., a dispersion or an emulsion of the particular compound and then adding it to the casting solution for the particular layer. The choice of a suitable solvent or dispersant depends upon the particular solubility of the compound.

Methods for introducing compounds substantially insoluble in water by grinding processes are described, for example, in DE-A-26 09 741 and DE-A-26 09 742.

Hydrophobic compounds may also be introduced into the casting solution using high-boiling solvents, so-called oil formers. Corresponding methods are described, for example in U.S. Pat. No. 2,322,027, U.S. Pat. No. 2,801,170, U.S. Pat. No. 2,801,171 and EP-A-0 043 037.

Instead of using high-boiling solvents, it is also possible to use oligomers or polymers, so-called polymeric oil formers. The compounds according to the invention are used in particular for the yellow-coupling layer.

The compounds may also be introduced into the casting solution in the form of charged latices, cf. for example DE-A-25 41 230, DE-A-25 41 274, DE-A-28 35 856, EP-A-0 014 921, EP-A-0 069 671, EP-A-0 130 115, U.S. Pat. No. 4,291,113.

Anionic water-soluble compounds (for example dyes) may also be incorporated in non-diffusing form with the aid of cationic polymers, so-called mordant polymers.

Suitable oil formers besides the compounds according to the invention are, for example, phthalic acid alkyl esters, phosphonic acid esters, phosphoric acid esters, citric acid esters, benzoic acid esters, amides, fatty acid esters, trimesic acid esters, alcohols, phenols, aniline derivatives and hydrocarbons.

Each of the differently sensitized photosensitive layers may consist of a single layer or may even comprise two or more silver halide emulsion layers (DE-C-1 121 470). Red-sensitive silver halide emulsion layers are often arranged nearer the layer support than green-sensitive silver halide emulsion layers which in turn are arranged nearer than blue-sensitive silver halide emulsion layers, a non-photosensitive yellow filter layer generally being present between green-sensitive layers and blue-sensitive layers.

Providing the natural sensitivity of the green-sensitive or red-sensitive layers is suitably low, it is possible to select other layer arrangements without the yellow filter layer, in which for example the blue-sensitive layers, then the red-sensitive layers and finally the green-sensitive layers follow one another on the support.

The non-photosensitive interlayers generally arranged between layers of different spectral sensitivity may contain agents to prevent unwanted diffusion of developer oxidation products from one photosensitive layer into another photosensitive layer with different spectral sensitization.

Suitable agents of the type in question, which are also known as scavengers or DOP trappers, are described in Research Disclosure 17 643 (December 1978), Chapter VII, 17 842 (February 1979) and 18 716 (November 1979) page 650 and in EP-A-0 069 070, 0 098 072, 0 124 877, 0 125 522.

Where several partial layers of the same spectral sensitization are present, they may differ from one another in regard to their composition, particularly so far as the type and quantity of silver halide crystals is concerned. In general, the partial layer of higher sensitivity is arranged further from the support than the partial layer of lower sensitivity. Partial layers of the same spectral sensitization may be arranged adjacent one another or may be separated by other layers, for example by layers of different spectral sensitization. For example, all the high-sensitivity layers and all the low-sensitivity layers may be respectively combined to form a layer unit or layer pack (DE-A-19 58 709, DE-A-25 30 645, DE-A-26 22 922).

The photographic material may also contain UV absorbers, whiteners, spacers, filter dyes, formalin scavengers, light stabilizers, antioxidants, $D_{min}$ dyes, additives for improving dye, coupler and white stabilization and for reducing color fogging, plasticizers (latices), biocides and other additives.

Certain binder layers, particularly the layer furthest from the support, but occasionally intermediate layers as well, particularly where they are the layer furthest from the support during production, may contain inorganic or organic, photographically inert particles, for example as matting agents or as spacers (DE-A-33 31 542, DE-A-34 24 893, Research Disclosure 17 643, (December 1978), Chapter XVI).

The mean particle diameter of the spacers is particularly in the range from 0.2 to 10 μm. The spacers are insoluble in water and may be insoluble or soluble in alkalis, the alkali-soluble spacers generally being removed from the photographic material in the alkaline development bath. Examples of suitable polymers are polymethyl methacrylate, copolymers of acrylic acid and methyl methacrylate and also hydroxypropyl methyl cellulose hexahydrophthalate.

Additives for improving dye, coupler and white stability and for reducing color fogging (Research Disclosure 17 643 (December 1978), Chapter VII) may belong to the following classes of chemical compounds: hydroquinones, 6-hydroxychromanes, 5-hydroxycoumaranes, spirochromanes, spiroindanes, p-alkoxyphenols, sterically hindered phenols, gallic acid derivatives, methylenedioxybenzenes, aminophenols, sterically hindered amines, derivatives containing esterified or etherified phenolic hydroxyl groups, metal complexes.

Compounds containing both a sterically hindered amine partial structure and also a sterically hindered phenol partial structure in one and the same molecule (U.S. Pat. No. 4,268,593) are particularly effective for preventing the impairment of yellow dye images as a result of the generation of heat, moisture and light. Spiroindanes (JP-A-159 644/81) and chromanes substituted by hydroquinone diethers or monoethers (JP-A-89 83 5/80) are particularly effective for preventing the impairment of magenta-red dye images, particularly their impairment as a result of the effect of light.

EXAMPLE 1

The following layers were applied to a layer support of paper coated on both sides with polyethylene. The quantities are based on 1 $m^2$. Layer 1: substrate layer of 200 mg gelatine Layer 2: green-sensitive silver chloride bromide emulsion layer (99.5 mole-% chloride) of 530 mg $AgNO_3$ containing 750 mg gelatine 0.61 g magenta coupler B-23 0.61 g TCP Layer 3: protective layer of 1 g gelatine and 120 mg hardener H1 corresponding to the following formula:

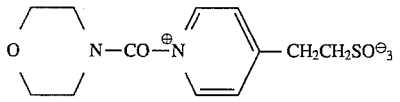

H1

In further samples, TCP was replaced by the compounds according to the invention listed in Table 1.

The samples thus prepared were exposed and processed in the usual way in the following processing baths.

| a) Color develolper - 45 s - 35° C. | |
|---|---|
| Triethanolamine | 9.0 g |
| NO,N-diethyl hydroxylamine | 4.0 g |
| Diethylene glycol | 0.05 g |
| 3-Methyl-4-amino-N-ethyl-N-methane-sulfonamidoethyl aniline sulfate | 5.0 g |
| Potassium sulfite | 0.2 g |
| Triethylene glycol | 0.05 g |
| Potassium carbonate | 22 g |
| Potassium hydroxide | 0.4 g |
| Ethylenediamine tetraacetic acid di-Na salt | 2.2 g |
| Potassium chloride | 2.5 g |
| 1,2-Dihydroxybenzene-3,4,6-tri-sulfonic acid trisodium salt | 0.3 g |
| Make up with water to 1000 ml; pH 10.0 | |
| b) Bleaching/fixing bath - 45 s - 35° C. | |
| Ammonium thiosulfate | 75 g/l |
| Sodium hydrogen sulfite | 13.5 g/l |
| Ammonium acetate | 2.0 g/l |
| Ethylenediamine tetraacetic acid (iron-ammonium salt) | 57 g/l |
| Ammonia, 25% by weight | 9.5 g/l |
| Acetic acid | 9.0 g/l |
| Make up with water to 1000 ml; pH 5.5 | |
| c) Washing - 2 mins. - 35° C. | |
| d) Drying | |

TABLE 1

| Sample | TCP (% by weight) | Compound I | % By weight | $D_{max}$ | G |
|---|---|---|---|---|---|
| 1 Comparison | 100 | — | — | 2.34 | 2.9 |
| 2 Invention | 80 | I-5 | 20 | 2.54 | 3.2 |
| 3 Invention | 80 | I-4 | 20 | 2.39 | 3.3 |
| 4 Invention | 80 | I-1 | 20 | 2.59 | 3.2 |
| 5 Invention | 80 | I-2 | 20 | 2.56 | 3.2 |
| 6 Invention | 60 | I-5 | 40 | 2.66 | 3.2 |
| 7 Invention | 60 | I-4 | 40 | 2.52 | 3.2 |
| 8 Invention | 60 | I-1 | 40 | 2.61 | 3.4 |
| 9 Invention | 60 | I-2 | 40 | 2.55 | 3.1 |

As Table 1 shows, a distinct increase in maximum density for steeper gradation is obtained with the coupler solvents according to the invention.

EXAMPLE 2

A color photographic recording material suitable for accelerated processing was produced by applying the following layers in the order shown to a layer support of paper coated on both sides with polyethylene. The quantities shown are all based on 1 $m^2$. For the silver halide applied, the corresponding quantities of $AgNO_3$ are shown.

| Material Sample 10 | |
|---|---|
| Layer 1: (substrate layer) | |
| 0.1 g | gelatine |
| Layer 2: (blue-sensitive layer) | |
| blue-sensitive silver halide emulsion (99.5 mole-% chloride, 0.5 mole-% bromide, mean grain diameter 0.9 μm) of | |
| 0.50 g | $AgNO_3$ and |
| 1.25 g | gelatine |
| 0.42 g | yellow coupler Y-1 |
| 0.18 g | yellow coupler Y-2 |
| 0.50 g | TCP |
| 0.10 g | tabilizer ST-1 |
| 0.3 mg | stabilizer ST-2 |
| Layer 3: (interlayer) | |
| 1.1 g | gelatine |
| 0.06 g | oxform trapper O-1 |
| 0.06 g | oxform trapper O-2 |
| 0.12 g | TCP |
| Layer 4: (green-sensitive layer) | |
| green-sensitized silver halide emulsion (99.5 mole-% chloride, 0.5 mole-% bromide, mean grain diameter 0.47 μm) of | |
| 0.4 g | $AgNO_3$ and |
| 0.77 g | gelatine |
| 0.41 g | magenta coupler B-23 |
| 0.2 g | image stabilizer C 20 |
| 0.1 g | image stabilizer C 24 |
| 0.12 g | oxform trapper O-2 |
| 0.5 mg | stabilizer ST-3 |
| 0.34 g | DBP |
| Layer 5: (UV-absorbing layer) | |
| 1.15 g | gelatine |
| 0.5 g | UV absorber UV-1 |
| 0.1 g | UV absorber UV-2 |
| 0.03 g | oxform trapper O-1 |
| 0.03 g | oxform trapper O-2 |
| 0.35 g | TCP |
| Layer 6: (red-sensitive layer) | |
| red-sensitized silver halide emulsion (99.5 mole-% chloride, 0.5 mole-% bromide, mean grain diameter 0.5 μm) of | |
| 0.3 g | $AgNO_3$ and |
| 1.0 g | gelatine |
| 0.46 g | cyan coupler C-1 |
| 0.46 g | TCP |
| 0.60 mg | stabilizer ST-4 |
| Layer 7: (UV-absorbing layer) | |
| 0.35 g | gelatine |
| 0.15 g | UV absorber UV-1 |
| 0.03 g | UV absorber UV-2 |
| 0.09 g | TCP |
| Layer 8: (protective layer) | |
| 0.9 g | gelatine |
| 0.3 g | hardener H-1 |
| 0.05 g | whitener W-1 |
| 0.07 g | polyvinyl pyrrolidone |
| 1.2 mg | silicone oil |
| 2.5 mg | polymethyl methacrylate beads with an average particle diameter of 0.8 μm |

Material Sample 10
Y-1
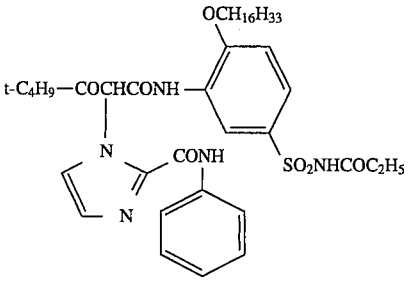
Y-2
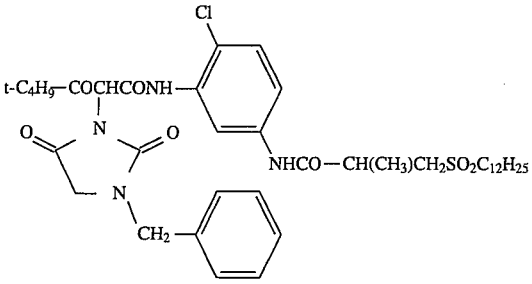
ST-1
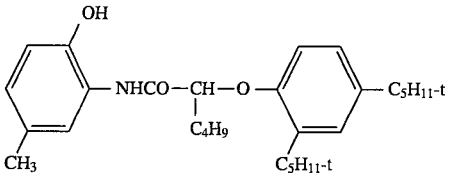
ST-2
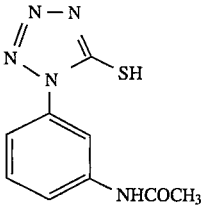
O-1
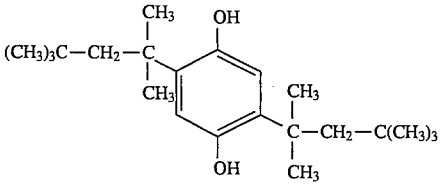
O-2
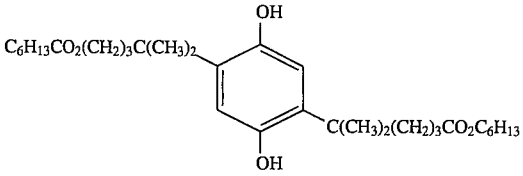
Material Sample 10
ST-3
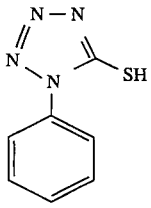
UV-1
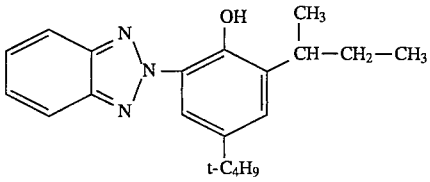
UV-2
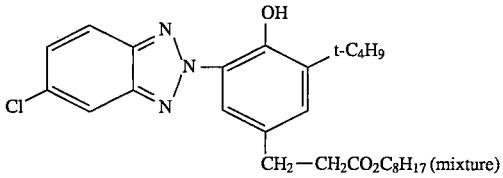
C-1
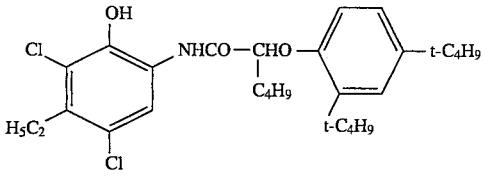
ST-4
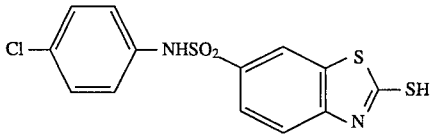
W-1
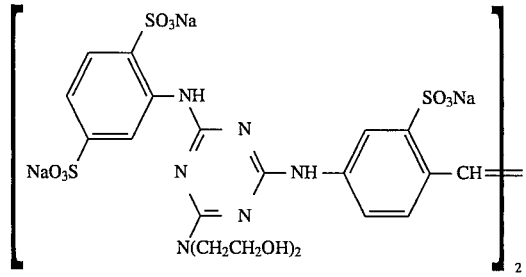
Samples 11 to 15 corresponded to sample 10 except that DBP was replaced by the compounds listed in Table 2.
The samples thus prepared were exposed and processed as in Example 1.

The processed samples were then covered with a UV-absorbing film and exposed to the light of a xenon tester (dose $15 \cdot 10^6$ lxh) to determine their fastness to light.

The UV absorbing film had been produced as follows: a layer of 1.5 g gelatine, 0.65 g UV absorber UV-1, 0.07 g dioctyl hydroquinone and 0.36 g TCP was applied to a transparent cellulose triacetate film provided with a binder layer. The quantities are all based on 1 $m^2$. The results are set out in Table 2.

The maximum density of the magenta dyes is distinctly increased by the compounds according to the invention as coupler solvents, as shown in Table 2. Compared with sample 10, comparison sample 11 shows no improvement in maximum density and a drastic deterioration in the light stability of the dye. In addition to the increase in maximum density, light stability is also improved by the compounds according to the invention.

TABLE 2

| Sample | Oil former (% by weight) | Compound I (% by weight) | $D_{max}$ magenta | Reduction in magenta density in % at density 1.0 |
|---|---|---|---|---|
| 10 Comparison | DBP (100) | — | 2.40 | −45 |
| 11 Comparison | Diethyl lauramide (100) | — | 2.39 | −68 |
| 12 Invention | DBP (60) | I-5 (50) | 2.70 | −27 |
| 13 Invention | DBP (60) | I-4 (40) | 2.50 | −43 |
| 14 Invention | DBP (60) | I-1 (40) | 2.65 | −44 |
| 15 Invention | DBP (60) | I-2 (40) | 2.60 | −41 |

I claim:

1. A color photographic silver halide material comprising at least one color coupler, wherein said at least one color coupler is dissolved or dispersed in a compound corresponding to formula (I):

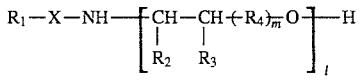

(I)

in which $R_1$ represents alkyl, alkenyl, cycloalkyl or cycloalkenyl, $R_2$ and $R_3$ independently of one another represent H, alkyl, alkenyl, cycloalkyl or cycloalkenyl, $R_4$ represents alkylene or alkenylene, X represents CO or $SO_2$, m 0 or 1 and l is a number from 1 to 5.

2. The color photographic silver halide martial as claimed in claim 1, wherein the compound of formula (I) is of the formula (II) or formula (III):

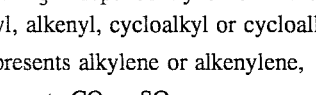

(II)

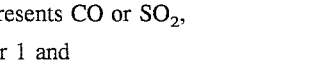

(III)

in which $R_1$ and l are as defined in claim 1.

3. The color photographic silver halide material as claimed in claim 1, wherein the coupler dissolved or dispersed in the compound of formula I is a magenta coupler corresponding to formula (IV):

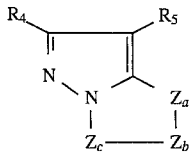

(IV)

in which $R_4$ represents H, alkyl, aralkyl or aryl;

$R_5$ H or a group releasable by coupling;

$Z_a$, $Z_b$ and $Z_c$ independently of one another represent an optionally substituted methine group, =N— or —NH—, the bond $Z_a$–$Z_c$ or the bond $Z_b$–$Z_c$ being a double bond and the other bond being a single bend.

4. The photographic silver halide material as claimed in claim 3, in which the coupler is of the formula IV-D or IV-E:

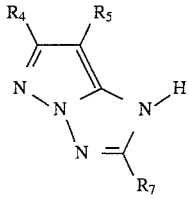

(IV-D)

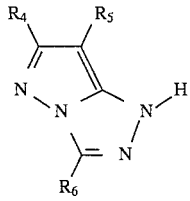

(IV-E)

in which $R_4$, $R_6$ and $R_7$ independently of one another represent hydrogen, alkyl, aralkyl, aryl, alkoxy, aroxy, alkylthio, arylthio, amino, anilino, acylamino, cyano, alkoxycarbonyl, carbamoyl or sulfamoyl which may in turn be substituted and $R_5$represents hydrogen or a group releasable during the color coupling reaction.

5. The color photographic silver halide material as claimed in claim 1, wherein $R_1$ is a linear or branched alkyl or alkenyl containing at least 8 carbon atoms, $R_2$ and $R_3$ independently of one another are hydrogen or methyl, $R_4$ is a linear or branched alkylene containing 1 to 8 carbon atoms, l has the value of 1, m is zero.

6. The color photographic silver halide material as claimed in claim 1, wherein the compound of formula (I) is selected from the group consisting of:

$$H_{23}C_{11}CONH-(CH_2)_2-O-(CH_2)_2-OH,$$

$$H_{35}C_{17}CONH-(CH_2)_2-O-(CH_2)_2-OH,$$

$$H_{23}C_{11}CONH-(CH_2CH_2O)_3-H,$$

$$H_{23}C_{11}CONH-CH_2-\underset{\underset{CH_3}{|}}{CH}-OH,$$

$$H_{35}C_{17}CONH-CH_2-\underset{\underset{CH_3}{|}}{CH}-OH,$$

$$H_{23}C_{11}CONH-(CH_2)_5-OH$$

and $$H_{23}C_{11}CONH-(CH_2)_3-OH.$$

7. The color photographic silver halide material as claimed in claim 1, wherein said coupler is used in a quantity from 0.1 to 100 mmols/$m^2$.

8. The color photographic silver halide material as claimed in claim 1, further comprising a light stabilizer corresponding to formula (V):

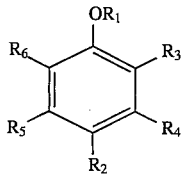

(V)

in which $R_1$ represents H, alkyl, aryl or acyl;

$R_2$ represents —$OR_1$, —COOH, alkyl, aryl, dialkylamino, acylamino, sulfonamido, acyl or sulfonyl;

$R_3$, $R_4$, $R_5$, $R_6$ independently of one another represent H, halogen or have the same meaning as $R_2$ or two adjacent substituents —$OR_1$, $R_2$, $R_3$, $R_4$, $R_5$ and $R_6$ can together complete a 5-to 8-membered ring.

9. The color photographic silver halide material as claimed in claim 5, wherein compounds corresponding to formula (V) are used in an amount of 0.05 to 3 g/g coupler.

10. The color photographic silver halide material as claimed in claim 9, wherein the compound of formula (V) is selected from the group consisting of:

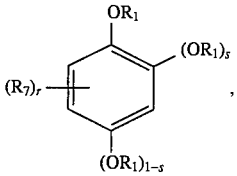

,

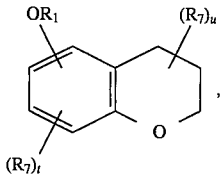

,

-continued

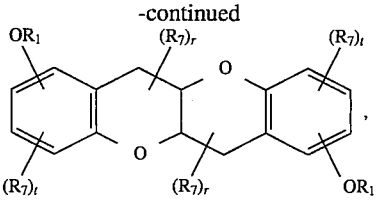

,

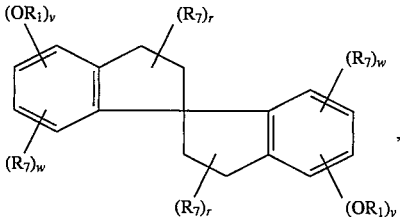

,

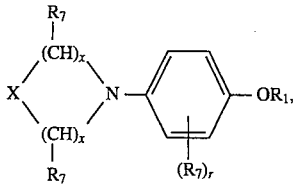

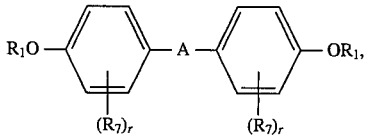

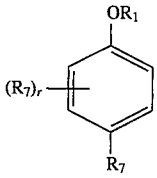

and

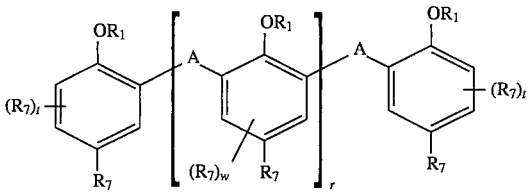

in which $R_7$ represents alkyl, acyl, acylamino, sulfonamido, or sulfonyl;

A is a single bond, —$CH(R_8)$—, —O—, —S—, —$SO_2$— or —$NR_9$—,

X is —O—, —S—, —SO—, —$SO_2$—, —N-acyl— or —CO—, $R_8$ represents H or alkyl, $R_9$ represents H, alkyl, acyl or sulfonyl, r is the number 0, 1, 2, 3 or 4;

s is the number 0 to 1;

t is the number 0, 1, 2, or 3;

u is the number 0, 1, 2, 3, 4, 5 or 6;

v is the number 1 or 2;

w is the number 0, 1 or 2 and x is the number 1, 2 or 3.

* * * * *